US007786830B2

(12) United States Patent
Wakatsuki et al.

(10) Patent No.: US 7,786,830 B2
(45) Date of Patent: Aug. 31, 2010

(54) SWITCH WITH MOVABLE PORTION

(75) Inventors: Noboru Wakatsuki, Ishinomaki (JP); Yu Yonezawa, Yokohama (JP); Naoyuki Mishima, Yokohama (JP); Tadashi Nakatani, Kawasaki (JP); Anh Tuan Nguyen, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 412 days.

(21) Appl. No.: 11/878,210

(22) Filed: Jul. 23, 2007

(65) Prior Publication Data

US 2008/0173524 A1 Jul. 24, 2008

(30) Foreign Application Priority Data

Jul. 27, 2006 (JP) ..... 2006-204136

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,619,061 | A * | 4/1997 | Goldsmith et al. | 257/528 |
| 2002/0195681 | A1 * | 12/2002 | Melendez et al. | 257/528 |
| 2003/0169137 | A1 * | 9/2003 | Wyeth et al. | 335/78 |
| 2005/0237064 | A1 * | 10/2005 | Kwark | 324/421 |
| 2008/0093691 | A1 * | 4/2008 | Busta | 257/415 |

FOREIGN PATENT DOCUMENTS

JP 2005-243576 A 9/2005

* cited by examiner

*Primary Examiner*—Elvin G Enad
*Assistant Examiner*—Bernard Rojas
(74) *Attorney, Agent, or Firm*—Arent Fox LLP

(57) ABSTRACT

A switch includes a movable portion, a first electrode and a second electrode. The movable portion is provided on a substrate and moves with respect to the substrate. The first electrode is provided on the movable portion. The second electrode is able to contact with the first electrode and is fixed to the substrate. $f \times Ro \times C \leqq 1.6 \times 10^{-4}$ when an operation frequency is represented as "f" (Hz), a transmission impedance is represented as "Ro" (Ω), and a capacitance in "OFF" state between the first electrode and the second electrode is represented as "C" (F).

6 Claims, 6 Drawing Sheets

SWITCH WITH MOVABLE PORTION

BACKGROUND OF THE INVENTION

1. Field of the Invention

This invention generally relates to a switch, and in particular, relates to a micro machine switch having a movable portion.

2. Description of the Related Art

A switch for switching a high-frequency signal has been used widely. For example, a GaAs semiconductor switch is used in a switching circuit for switching between sending and receiving circuits such as a cellular phone, because the GaAs semiconductor switch has high responsivity. However, with respect to the GaAs substrate switch, an electrical loss in "ON" state is large and isolation in "OFF" state is low. And so, a MEMS (Micro Electro Mechanical System) switch manufactured with a micro machine processing technology using a Si substrate is noted. In the MEMS switch (Micro Machine Switch), the electrical loss in "ON" state is small and the isolation in "OFF" state is large, because an electrical contact is turned on and off directly. Japanese Patent Application Publication No. 2005-243576 discloses the MEMS switch.

However, the isolation of the MEMS switch in the "OFF" state is degraded when the operation frequency is high. For example, there is a demand for reducing the isolation level in the "OFF" state less than −30 dB. However, there is a case where the isolation level in "OFF" state is more than −30 dB in the MEMS switch using a high frequency wave. A requirement affecting the isolation level in "OFF" state has not been examined with respect to the MEMS switch.

SUMMARY OF THE INVENTION

The present invention provides a switch that may enlarge the isolation in "OFF" state thereof.

According to an aspect of the present invention, preferably, there is provided a switch including a movable portion, a first electrode and a second electrode. The movable portion is provided on a substrate and moves with respect to the substrate. The first electrode is provided on the movable portion. The second electrode is able to contact with the first electrode and is fixed to the substrate. $f \times Ro \times C \leqq 1.6 \times 10^{-4}$ when an operation frequency is represented as "f" (Hz), a transmission impedance is represented as "Ro" (Ω), and a capacitance in "OFF" state between the first electrode and the second electrode is represented as "C" (F). With the above-mentioned configuration, the isolation may be high in "OFF" state.

According to another aspect of the present invention, preferably, there is provided a switch including a movable portion, a first electrode, a second electrode, and a third electrode. The movable portion is provided on a substrate. The first electrode is provided on the movable portion. The second electrode and a third electrode are able to contact with the first electrode and are fixed to the substrate. A high frequency signal flows from one of the second electrode and the third electrode to the other through the first electrode. $f \times Ro \times C \leqq 3.2 \times 10^{-4}$ when an operation frequency is represented as "f" (Hz), a transmission impedance is represented as "Ro" (Ω), and a capacitance in "OFF" state between the first electrode and the second electrode and between the first electrode and the third electrode is represented as "C" (F). With the above-mentioned configuration, the isolation may be high in the switch that turns on and turns off a flow of electrical power from the second electrode to the third electrode.

BRIEF DESCRIPTION OF THE DRAWINGS

Preferred embodiments of the present invention will be described in detail with reference to the following drawings, wherein.

DESCRIPTION OF THE PREFERRED EMBODIMENTS

A description will now be given, with reference to the accompanying drawings, of embodiments of the present invention.

First Embodiment

A first embodiment is a case where an isolation level in "OFF" state is less than −30 dB when there is one contact point. Here, the isolation level is low, when the isolation is high.

Figure 1A:
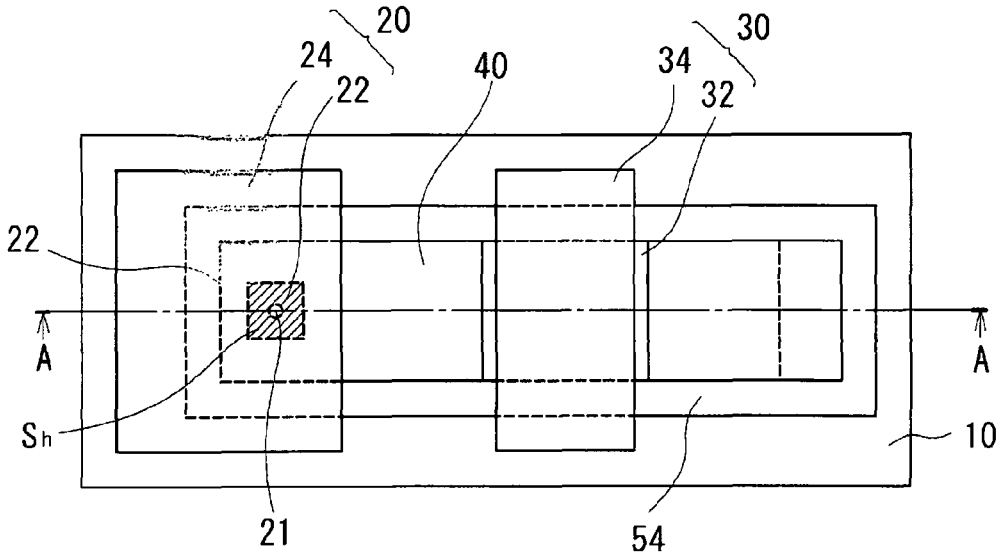
FIG. 1A illustrates a top view of a switch in accordance with a first embodiment.
Figure 1B:
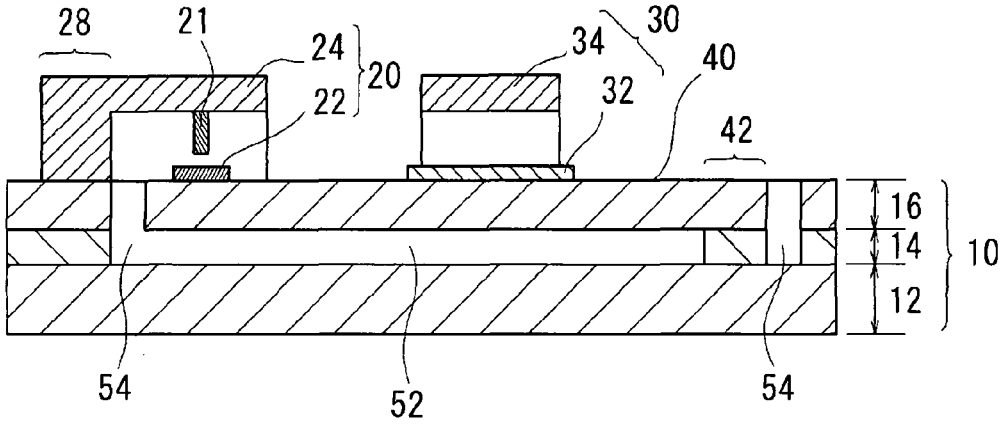
FIG. 1B illustrates a cross sectional view taken along a line A-A of FIG. 1A.

FIG. 1A illustrates a top view of a switch in accordance with the first embodiment. FIG. 1B illustrates a cross sectional view taken along a line A-A of FIG. 1A. In FIG. 1A, a second electrode 24, a movable beam 40 under an upper electrode 34, a first electrode 22 and a projection electrode 21 are shown with a dotted line. The switch is composed of a substrate 10, the movable beam (a movable portion) 40, a connection portion 20 and a drive portion 30. The substrate 10 has a silicon oxide layer as a sacrificial layer 14 on a silicon substrate 12 and has a silicon layer as a semiconductor layer 16 on the sacrificial layer 14. The movable beam 40 is composed of a layer that is same as the semiconductor layer 16. One end of the movable beam 40 is fixed to the substrate 10 at a fixing portion 42 through the sacrificial layer 14. A groove 54 is formed around the movable beam 40. The groove 54 reaches to the silicon substrate 12. The sacrificial layer 14 under the movable beam 40 except for the fixing portion 42 is eliminated and a space 52 is formed. The first electrode 22 is provided on the other end of the movable beam 40. The second electrode 24 is provided above the first electrode 22 so as to face an upper face of the first electrode 22. The second electrode 24 is fixed to the substrate 10 at a fixing portion 28. The second electrode 24 has the projection electrode 21. The projection electrode 21 is able to contact with the first electrode 22. This results in that the first electrode 22 and the second electrode 24 compose the connection portion 20. The drive portion 30 has a lower electrode 32 that is provided on the movable beam 40, and has the upper electrode 34 that is provided above the lower electrode 32 and is fixed to the substrate 10.

Figure 2A:
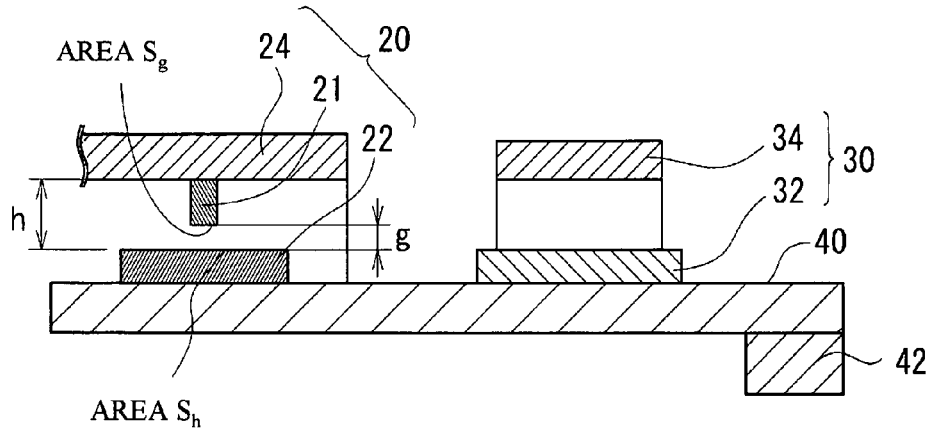
FIG. 2A illustrates "OFF" state of a switch in accordance with a first embodiment.
Figure 2B:
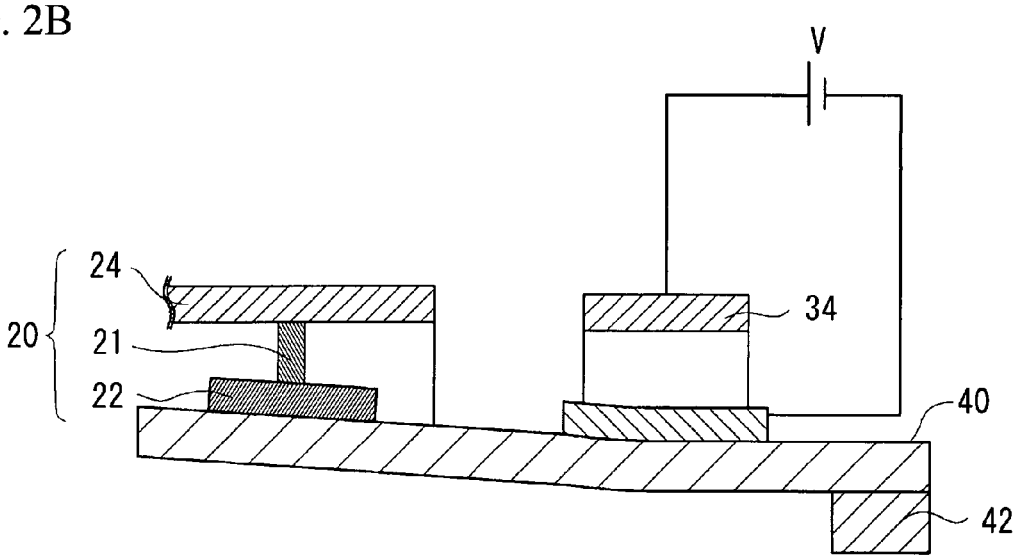
FIG. 2B illustrates "ON" state of a switch in accordance with a first embodiment.

FIG. 2A and FIG. 2B illustrate a schematic view showing an operation of the switch in accordance with the first embodiment. As shown in FIG. 2A, the first electrode 22 and the projection electrode 21 of the second electrode 24 are not in touch with each other and a state of the switch is "OFF", when there is no voltage applied between the lower electrode 32 and the upper electrode 34. As shown in FIG. 2B, an attracting force is generated when a voltage V is applied between the lower electrode 32 and the upper electrode 34 of the drive portion 30. This causes the movable beam 40 provided on the lower electrode 32 to move toward the upper electrode 34 fixed to the substrate 10. This results in that the first electrode 22 is electrically connected to the projection electrode 21 and the state of the switch is changed to "ON" (electrically conducted). When the voltage V is shut off, the state of the switch is changed to "OFF" as shown in FIG. 2A. Accordingly, the device acts as a switch.

Figure 3:
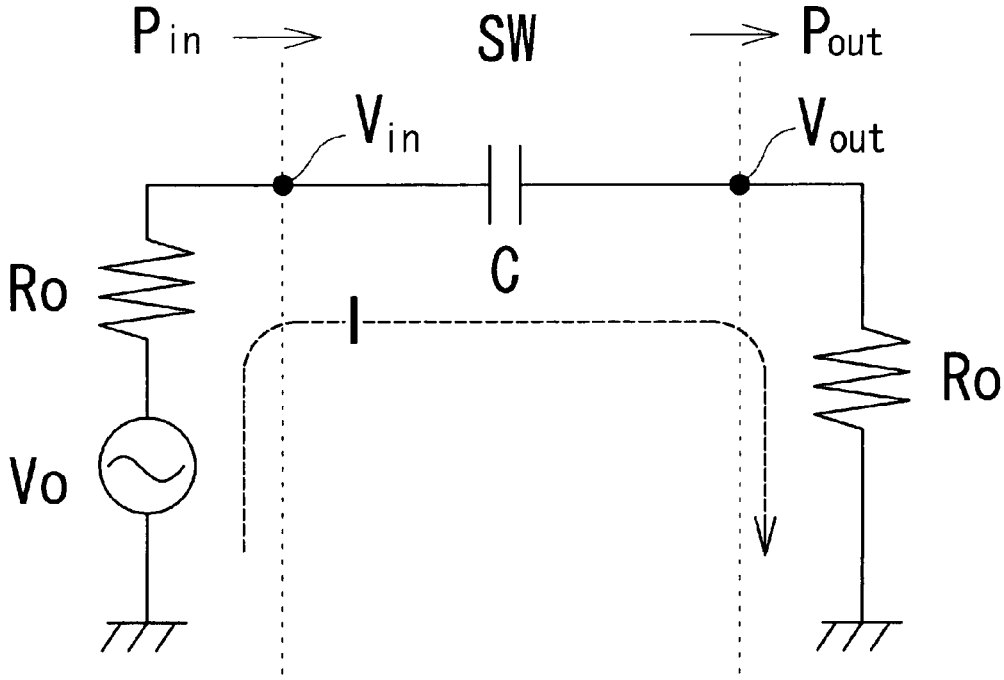
FIG. 3 illustrates an equivalent circuit of a switch in accordance with a first embodiment.

A description will be given of a structure that may reduce the isolation level in "OFF" state, with reference to FIG. 3. As shown in FIG. 3, an RF voltage is represented as "Vo", each of power supply side transmission impedance and output load side transmission impedance is represented as "Ro", a current passing through a MEMS switch SW is represented as "I", and a capacitance of the MEMS switch SW is represented as "C". When an electrical power fed into the MEMS switch SW is represented as $P_{in}$, an electrical power from the MEMS switch is represented as $P_{out}$, a voltage at an inputting end of the MEMS switch is represented as $V_{in}$, and a voltage at an outputting end of the MEMS switch is represented as $V_{out}$ at frequency f, these are shown as following expressions.

$$V_{in}=Ro\cdot I+Vo \quad \text{(Expression 1)}$$

$$V_{out}=Ro\cdot I \quad \text{(Expression 2)}$$

$$\text{Impedance } Z \text{ of the MEMS switch } SW=1/(j\cdot 2\pi f\cdot C) \quad \text{(Expression 3)}$$

($V_{in}-V_{out}$) is shown as following Expression 4 according to Expression 1 through Expression 3.

$$V_{in}-V_{out}=Vo=I/(j\cdot 2\pi f\cdot C) \quad \text{(Expression 4)}$$

$P_{in}$ and $P_{out}$ are shown as following Expression 5 and Expression 6 respectively according to Expression 1 and Expression 2.

$$P_{in}=|I\cdot V_{in}|=|Ro\cdot I^2+I\cdot Vo| \quad \text{(Expression 5)}$$

$$P_{out}=|I\cdot V_{out}|=|Ro\cdot I^2| \quad \text{(Expression 6)}$$

The isolation level IL between the inputting end and the outputting end of the MEMS switch is shown as following Expression 7 according to Expression 5 and Expression 6.

$$IL(\text{dB})=10\log_{10}(|P_{out}/P_{in}|)=10\log_{10}(|1/|1+Vo/(Ro\cdot I)|) \quad \text{(Expression 7)}$$

When an operation frequency of the MEMS switch SW is a few GHz and the capacitance C is a few fF, following Expression 8 is obtained.

$$|Vo/(Ro\cdot I)|\gg 1 \quad \text{(Expression 8)}$$

Therefore, Expression 6 is shown as following Expression 9 according to Expression 4 and Expression 8.

$$IL(\text{dB})=10\log_{10}(|(Ro\cdot I)/Vo|)=10\log_{10}(2\pi fRoC) \quad \text{(Expression 9)}$$

In order to reduce the isolation level less than −30 dB, a relationship shown in following Expression 10 and Expression 11 are necessary.

$$2\pi f\cdot Ro\cdot C\leqq 10^{-3} \quad \text{(Expression 10)}$$

$$f\cdot Ro\cdot C\leqq 1.6\times 10^{-4} \quad \text{(Expression 11)}$$

When the power supply side transmission impedance Ro and the output load side transmission impedance Ro are 50Ω being commonly used or more than 50Ω, following Expression 12 is obtained.

$$f\cdot C\leqq 3.2\times 10^{-6}\ \text{F}\cdot\text{s}^{-1} \quad \text{(Expression 12)}$$

When the operation frequency is higher than 5 GHz, following Expression 13 is obtained.

$$C\leqq 6.4\times 10^{-16}\ \text{F}=64\ \text{fF} \quad \text{(Expression 13)}$$

This results in that the isolation level is less than −30 dB when Expression 11, Expression 12 or Expression 13 is satisfied.

As shown in FIG. 2A, a distance between the projection electrode 21 and the first electrode 22 is represented as "g", an end area of the projection electrode 21 is represented as "$S_g$", a distance between the first electrode 22 and an area of the second electrode 24 except for the projection electrode 21 is represented as "h", an area of a region where the first electrode 22 and the second electrode 24 are facing to each other is represented as "$S_h$" (a hatched area of FIG. 1A). In this case, "C" is shown as following Expression 14.

$$C=\epsilon o\cdot(S_h-S_g)/h+\epsilon o\cdot S_g/g \quad \text{(Expression 14)}$$

Here, when following Expression 15 is satisfied, "C" is shown as following Expression 16 approximately.

$$\epsilon o\cdot S_h/h>(1/10)\times(\epsilon o\cdot S_g/g) \quad \text{(Expression 15)}$$

$$C\approx\epsilon o\cdot S_h/h \quad \text{(Expression 16)}$$

Generally, "g" is approximately 0.2 μm and "$S_g$" is approximately 1 $\mu m^2$. As mentioned later, "h" is a few μm and "$S_h$" is 360 $\mu m^2$. This results in that Expression 15 is satisfied. Therefore, in order to satisfy Expression 13, a relationship shown in following Expression 17 and Expression 18 are necessary.

$$S_h/h\leqq 72\ \mu\text{m} \quad \text{(Expression 17)}$$

$$S_h\leqq 360\ \mu\text{m}^2 \quad \text{(Expression 18)}$$

(in a case where "h" is more than 3 μm)

That is, it is preferable that "$S_h$" is less than approximately 19 μm×19 μm. It is therefore possible to reduce the isolation level IL less than −30 dB when Expression 17 or Expression 18 is satisfied.

Second Embodiment

Figure 4A:
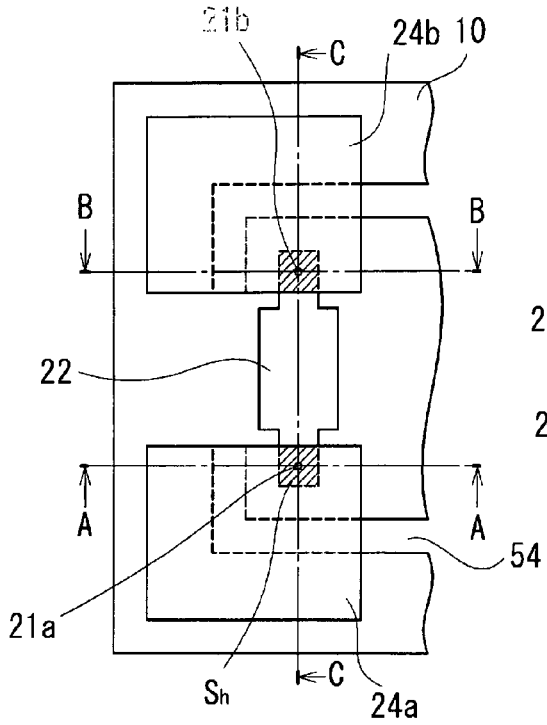
FIG. 4A illustrates a top view of a switch in accordance with a second embodiment.
Figure 4C:
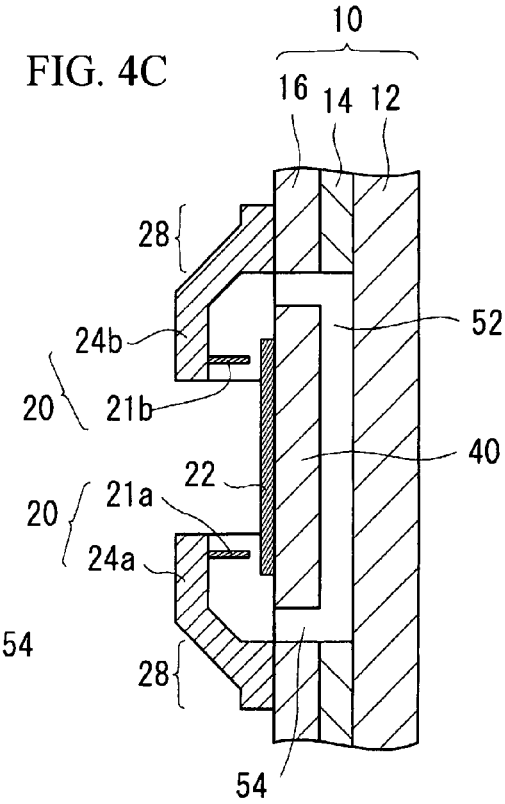
FIG. 4C illustrates a cross sectional view taken along a line C-C of FIG. 4A.
Figure 4B:
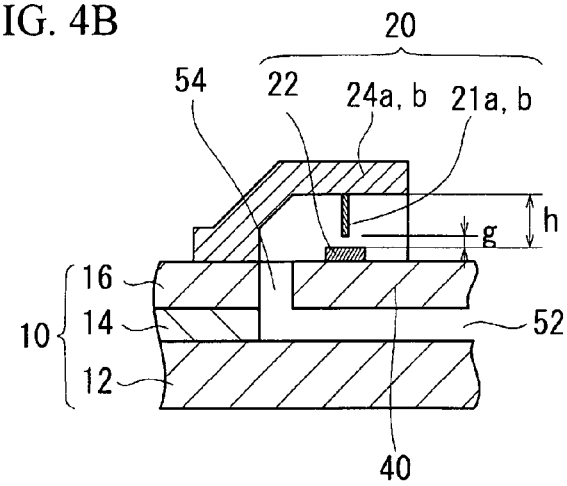
FIG. 4B illustrates a cross sectional view taken along lines A-A and B-B of FIG. 4A.

A second embodiment is a case where states of two connection portions are changed to "ON" and to "OFF" substantially at one time. FIG. 4A illustrates a top view around a connection portion of a switch in accordance with the second embodiment. FIG. 4B illustrates a cross sectional view taken along lines A-A and B-B of FIG. 4A. FIG. 4C illustrates a cross sectional view taken along a line C-C of FIG. 4A. The switch has a second electrode 24*a* and a third electrode 24*b* that are able to contact with the first electrode 22 and are fixed to the substrate 10. A high-frequency signal is transmitted from one of the second electrode 24*a* and the third electrode 24*b* to the other through the first electrode 22, when the second electrode 24*a* and the third electrode 24*b* are in touch with the first electrode 22 substantially at one time. A projection electrode 21*a* is provided on the second electrode 24*a*. A projection electrode 21*b* is provided on the third electrode 24*b*. The projection electrodes 21*a* and 21*b* are used for coupling the second electrode 24*a* and the third electrode 24*b* to the first electrode 22 respectively. Other structures are in common with the first embodiment. With the structure, it is possible to turn on and turn off the flow of electrical power from the second electrode 24*a* to the third electrode 24*b*.

Figure 5:
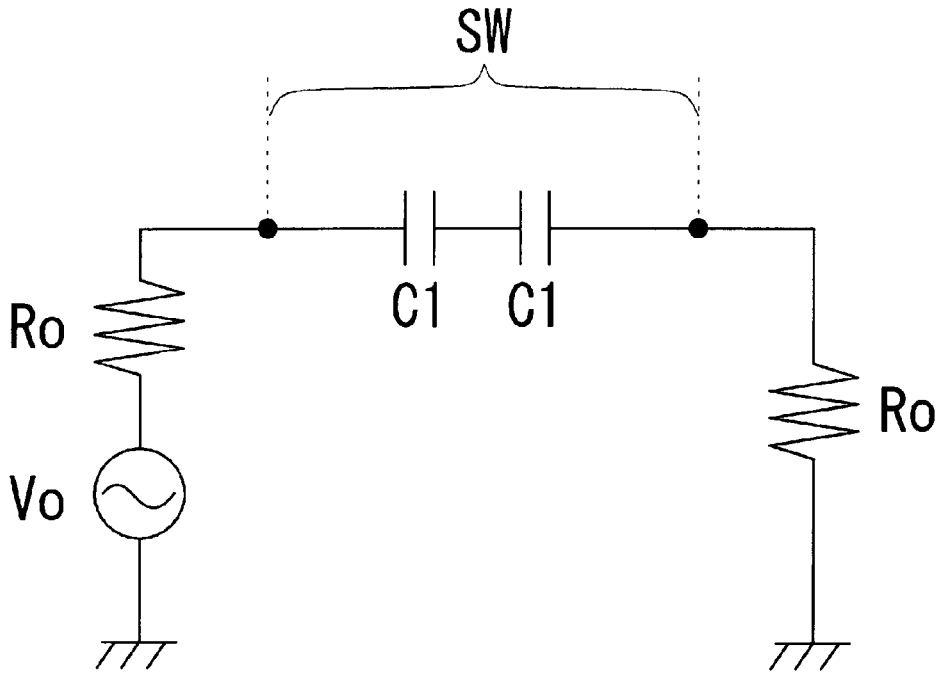
FIG. 5 illustrates an equivalent circuit of a switch in accordance with a second embodiment.

FIG. 5 illustrates an equivalent circuit of a switch in "OFF" state in accordance with the second embodiment. Two capacitances C1 are coupled to the MEMS switch SW in series, being different from FIG. 3. When the capacitances at the two connection portions 20 are substantially equal to each other, a relationship shown in following Expression 19 is necessary according to Expression 11, in order to reduce the isolation level less than −30 dB.

$$f \cdot Ro \cdot C1 \leqq 3.2\times10^{-4} \quad \text{(Expression 19)}$$

When the power supply side transmission impedance Ro and the output load side transmission impedance Ro are more than 50Ω, following expression 20 is obtained.

$$f \cdot C1 \leqq 6.4\times10^{-5}\ \mathrm{F\cdot s^{-1}} \quad \text{(Expression 20)}$$

When the operation frequency is higher than 5 GHz, following Expression 21 is obtained.

$$C1 \leqq 12.8\times10^{-16}\ \mathrm{F} = 128\ \mathrm{fF} \quad \text{(Expression 21)}$$

This results in that the isolation level is less than −30 dB when Expression 19, Expression 20 or Expression 21 is satisfied.

As shown in FIG. 4A and FIG. 4B, a distance between the first electrode 22 and a region of the second electrode 24*a* and the third electrode 24*b* except for the projection electrode 21 is represented as "h". An area of a region where the first electrode 22 faces the second electrode 24*a* and the third electrode 24*b* is represented as "$S_h$". In this case, "C1" is shown in following Expression 22 similarly to Expression 15.

$$C1 = \epsilon o \cdot (S_h - S_g)/h + \epsilon o \cdot S_g/g \quad \text{(Expression 22)}$$

When following Expression 23 is satisfied, following Expression 24 and Expression 25 are obtained.

$$\epsilon o \cdot S_h/h > (1/10) \times (\epsilon o \cdot S_g/g) \quad \text{(Expression 23)}$$

$$S_h/h \leqq 144\ \mu\mathrm{m} \quad \text{(Expression 24)}$$

$$S_h \leqq 720\ \mu\mathrm{m}^2 \quad \text{(Expression 25)}$$

(in a case where "h" is more than 3 μm)

That is, it is preferable that "$S_h$" is less than approximately 27 μm×27 μm.

This results in that the isolation level is less than −30 dB in the second embodiment when Expression 24 or Expression 25 is satisfied. It is preferable that Expression 19, 20, 21, 24 or 25 is satisfied with respect to both of the connection portions 20.

When one of the connection portions 20 is electrically shorted or the capacitance of one of the connection portions 20 is very large, the isolation level is maintained with the other connection portion 20. In this case, the isolation level is less than −30 dB when Expression 11, 12, 13, 17 or 18 in the first embodiment is satisfied.

Third Embodiment

Figure 6:
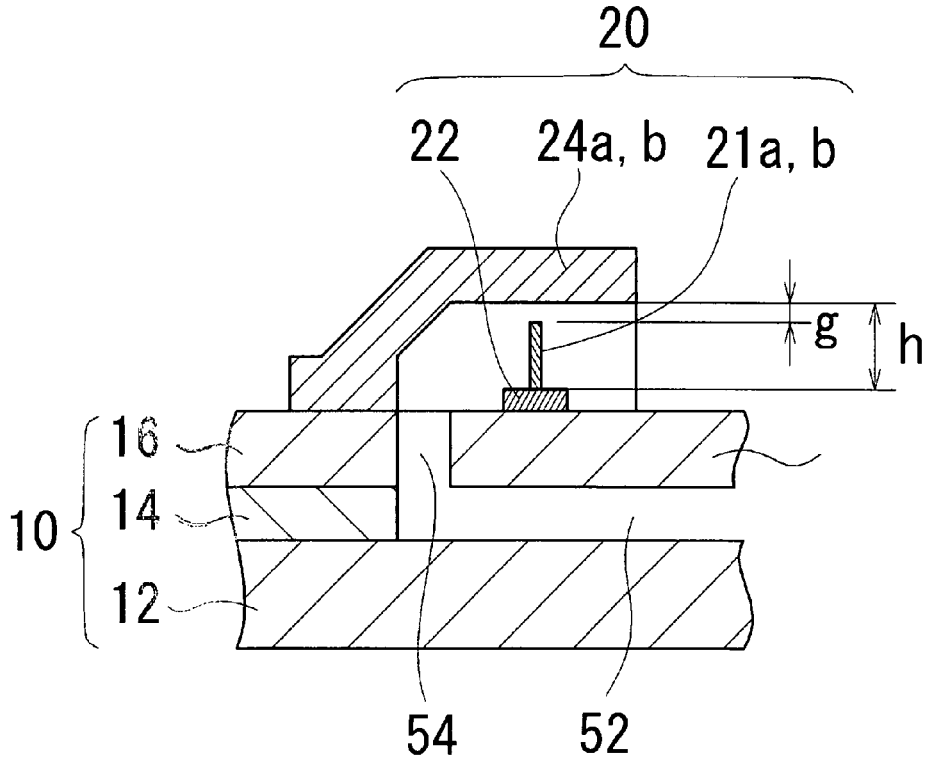
FIG. 6 illustrates a cross sectional view of a switch in accordance with a third embodiment.

A third embodiment is a case where the projection electrode 21 is provided on the first electrode 22. FIG. 6 corresponds to FIG. 4B. The projection electrode 21 may be provided on the first electrode 22. And, the projection electrode 21 of one of the two connection portions 20 may be provided on the first electrode 22. The projection electrode 21 of the other connection portions 20 may be provided on the second electrode 24*a* or on the third electrode 24*b*.

It is preferable that the first electrode 22 has the projection electrode 21 for contacting with the second electrode 24*a* and the third electrode 24*b* or that the second electrode 24*a* and the third electrode 24*b* have the projection electrode 21 for contacting with the first electrode 22, as shown in the second embodiment and the third embodiment. And, the projection electrode 21 may be provided on the first electrode 22 in the first embodiment.

In the first through the third embodiments, the projection electrode 21 is provided. However, the projection electrode 21 may not be provided if the first electrode 22 can be electrically connected and unconnected to the second electrode 24 or if the first electrode 22 can be electrically connected and unconnected to the second electrode 24*a* and the third electrode 24*b*. Further, a plurality of the projection electrodes 21 may be provided on one connection portion 20.

In the above-mentioned embodiments, the drive portion 30 is an electrostatically driving portion that moves the movable beam 40 when a voltage is applied between the lower electrode 32 and the upper electrode 34. The drive portion 30 may move the movable beam 40 (a movable portion), and may be a piezo drive portion, a heat drive portion, or a magnetic drive portion. And, in the above-mentioned embodiments, the switch is a normally off type switch of which state is "OFF" when no voltage is applied to the drive portion 30. The switch may be a normally on type switch. In the above-mentioned embodiments, one end of the movable beam 40 is fixed to the substrate 10 and the other end has the connection portion 20. The movable portion may act as a connection point at the connection portion 20 when the movable portion moves with respect to the substrate 10.

While the preferred embodiments of the prevent invention have been illustrated in detail, the invention is not limited to the specific embodiments above. In addition, it will be appreciated that the invention is susceptible of modification, variation and change without departing from the proper and fair meaning of the accompanying claims.

The present invention is based on Japanese Patent Application No. 2006-204136 filed on Jul. 27, 2006, the entire disclosure of which is hereby incorporated by reference.

What is claimed is:

1. A switch comprising:

a movable portion that is provided on a substrate and moves with respect to the substrate;

a first electrode that is provided on the movable portion; and a second electrode that is able to contact with the first electrode and is fixed to the substrate, wherein:

one of the first electrode and the second electrode is connected to a power supply;

the other of the first electrode and the second electrode is connected to an output load; and $f \times Ro \times C \leqq 1.6\times10^{-4}$ when an operation frequency is represented as "f" (Hz), a transmission impedance of each of the power supply side and the output load side is represented as "Ro" (Ω), and a capacitance in "OFF" state between the first electrode and the second electrode is represented as "C" (F).

2. The switch as claimed in claim 1 further comprising a projection electrode that is provided on one of the first electrode and the second electrode and is able to contact with the other of the first electrode and the second electrode.

3. The switch as claimed in claim 1, wherein $f \times C \leqq 3.2 \times 10^{-6}$ F·Hz.

4. The switch as claimed in claim 1, wherein $C \leqq 6.4 \times 10^{-16}$ F.

5. The switch as claimed in claim 1, wherein $Sh/h \leqq 72$ μm when an area of a region where the first electrode and the second electrode face to each other is represented as "Sh" and a distance between the first electrode and the second electrode is represented as "h".

6. The switch as claimed in claim 5, wherein $Sh \leqq 360$ $\mu m^2$.

* * * * *